US007404272B2

(12) United States Patent
Piché

(10) Patent No.: US 7,404,272 B2
(45) Date of Patent: Jul. 29, 2008

(54) PROTECTIVE BASEBOARD

(76) Inventor: Michel Piché, 12059 Edger, Montréal-Nord, Quebec (CA) H1G 5A7

( * ) Notice: Subject to any disclaimer, the term of this patent is extended or adjusted under 35 U.S.C. 154(b) by 245 days.

(21) Appl. No.: 11/183,909

(22) Filed: Jul. 19, 2005

(65) Prior Publication Data

US 2005/0284055 A1 Dec. 29, 2005

Related U.S. Application Data

(60) Provisional application No. 60/683,306, filed on May 23, 2005.

(51) Int. Cl.
*E04B 2/00* (2006.01)
*E04B 5/00* (2006.01)

(52) U.S. Cl. ..... 52/287.1; 52/272; 52/742.13; 52/742.14; 52/290

(58) Field of Classification Search ..... 52/35, 52/273, 290, 292, 287.1, 288.1, 738.1, 724.5, 52/723.1, 723.2, 742.13, 742.14
See application file for complete search history.

(56) References Cited

U.S. PATENT DOCUMENTS

| | | | | | |
|---|---|---|---|---|---|
| 820,641 | A * | 5/1906 | Gleason | 52/100 |
| 1,243,001 | A * | 10/1917 | Stewart | 52/734.1 |
| 1,555,392 | A * | 9/1925 | Tracy et al. | 52/273 |
| 1,977,076 | A * | 10/1934 | Mann | 52/273 |
| 2,000,243 | A * | 5/1935 | Manske | 52/220.7 |
| 2,052,033 | A * | 9/1936 | Peck et al. | 52/290 |
| 2,178,501 | A * | 10/1939 | Staneampiano et al. | 52/288.1 |
| 2,915,794 | A * | 12/1959 | Hillmann | 52/287.1 |
| 3,062,342 | A * | 11/1962 | Clements | 52/273 |
| 4,071,994 | A * | 2/1978 | Ammann | 52/393 |
| 4,601,149 | A * | 7/1986 | Dokan | 52/287.1 |
| 4,706,427 | A * | 11/1987 | Zeilinger | 52/287.1 |
| 4,910,280 | A * | 3/1990 | Robbins, III | 428/71 |
| 5,598,681 | A * | 2/1997 | DiGianni | 52/717.05 |
| 6,584,743 | B2 * | 7/2003 | Paxton et al. | 52/312 |
| 2001/0032432 | A1 * | 10/2001 | Paxton et al. | 52/311.2 |

FOREIGN PATENT DOCUMENTS

JP 2006177035 A * 7/2006

* cited by examiner

*Primary Examiner*—David V Bruce
*Assistant Examiner*—Brent W Herring

(57) ABSTRACT

A protective baseboard for protecting a building wall in an industry requiring sanitary requirements. The protective baseboard is positionable substantially adjacent the ground surface. The protective baseboard includes a substantially rigid and substantially water proof casing. The casing defines a casing external wall, the casing external wall having a casing wall inner surface. The casing also defines a casing inner volume and a filling aperture extending therethrough. The casing is positionable in a predetermined relationship relative to the building wall. A filler is provided within the casing inner volume. The filler substantially contacts the casing inner surface for minimizing an amount of air between the filler and the casing external wall.

13 Claims, 13 Drawing Sheets

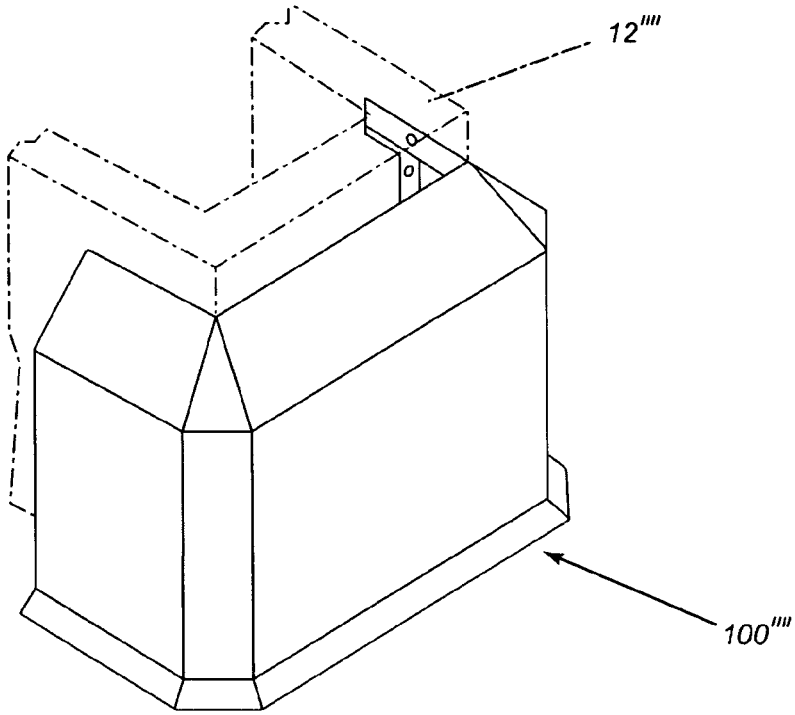
FIG. 23
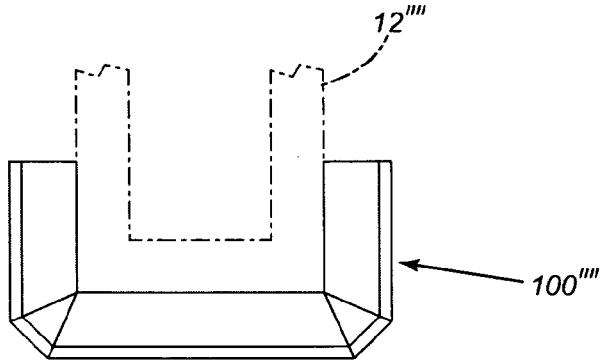
FIG. 26
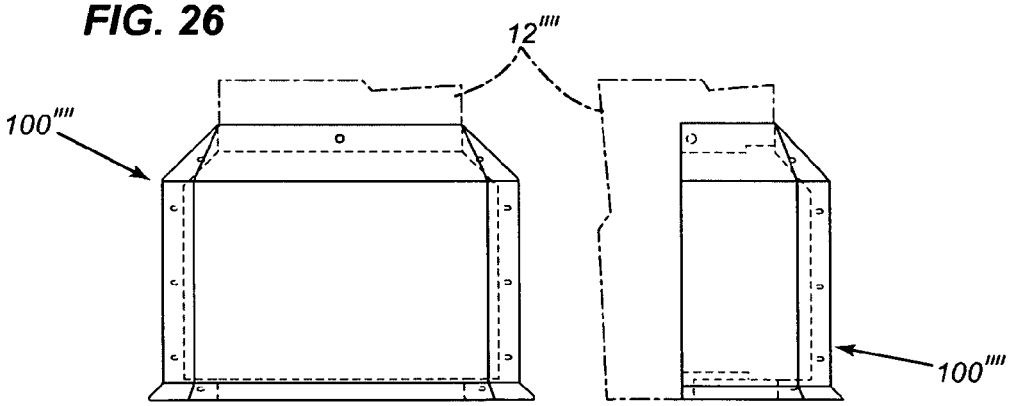
FIG. 24
FIG. 25

PROTECTIVE BASEBOARD

This Application claims priority from U.S. Provisional Patent Application 60/683,306 filed on May 23, 2005.

FIELD OF THE INVENTION

The present invention relates to the protection of walls in industries requiring sanitary precautions. More specifically, the present invention is concerned with a protective baseboard for protecting walls in an industry requiring sanitary precautions.

BACKGROUND OF THE INVENTION

In many industries, walls are sometimes protected by baseboards. These baseboards typically protect the wall against impacts, for example against impacts from carriages. In industries requiring sanitary precautions, for example in the food industry, some traditional baseboards used for protecting walls are made of concrete coated with an epoxy. The epoxy is required because the walls and their baseboards are typically washed relatively often to maintain sanitary conditions within a building into which they are provided.

The above-described baseboards have many drawbacks. For example, such baseboards may take a relatively long time to build if the concrete used in these baseboards takes a relatively long time to solidify. For example, a typical baseboard used in the food industry may take up to two weeks to solidify before an epoxy coating can be applied.

In addition, the epoxy is relatively fragile and may be broken by relatively small impacts. Furthermore, it also sometimes happens that the epoxy delaminates from the concrete. In both cases, there is a need to repair the baseboard.

Such repairs imply that the factory into which the baseboard is provided may need to be shut down, at least in part. In addition, such repairs are relatively labor intensive. Therefore such repairs are relatively expensive.

In addition, not any type of baseboard is usable in industries requiring sanitary precautions. Indeed, the baseboards need to be relatively easily washable and to be relatively resistant to the implementation of pathogens thereinto, thereon or both thereinto and thereon.

Against this background, there exists a need in the industry to provide a novel protective baseboard. Accordingly, an object of the present invention is therefore to provide an improved protective baseboard.

SUMMARY OF THE INVENTION

In a first broad aspect, the invention provides a protective baseboard for protecting a building wall in an industry requiring sanitary precautions. The protective baseboard is positionable substantially adjacent the ground surface. The protective baseboard includes a substantially rigid and substantially water proof casing. The casing defines a casing external wall, the casing external wall having a casing wall inner surface. The casing also defines a casing inner volume and a filling aperture extending therethrough. The casing is positionable in a predetermined relationship relative to the building wall. A filler is provided within the casing inner volume. The filler substantially contacts the casing inner surface for minimizing an amount of air between the filler and the casing external wall.

Advantageously, the protective baseboard takes a relatively short time to manufacture. Indeed, since the filler is protected by the casing, in a case wherein the filler material includes concrete it is possible to use a relatively lower quality concrete that solidifies more rapidly than concrete used in some prior art baseboards.

In addition, the casing is in some embodiments of the invention relatively more robust than the epoxy used in some prior art baseboards and therefore relatively reduces the time spent on maintaining and repairing the baseboard. This relatively reduces downtime in the factory into which the baseboard is installed and also relatively reduces labor costs associated with such repairs.

In some embodiments of the invention, a removable formwork is provided for reinforcing the casing prior to pouring a filling material in the form of concrete thereinto. The temporary formwork insures that the formations of the casing under the weight of the concrete are relatively small and that when solidifying, the concrete remains substantially in contact with the casing wall inner surface.

A retraction of the concrete from the casing wall inner surface forming an air pocket inside the casing would be undesirable in some industries. For example, if the baseboard is installed in a room in which there are temperature variations, the air pocket may lead to the formation of condensation within the baseboard if the temperature within the room decreases. This condensation may lead, for example, to bacterial growth and the bacteria thereby produced risk to be released into the room.

In another broad aspect, the invention provides a casing module for assembling a protective baseboard for protecting a building wall in an industry requiring sanitary precautions.

In another broad aspect, the invention provides a combination of a building wall and a protective baseboard for use in an industry requiring sanitary precautions.

In yet another broad aspect, the invention provides a method for building a protective baseboard for protecting a building wall in an industry requiring sanitary precautions. The protective baseboard is positionable substantially adjacent the ground surface. The baseboard has a substantially rigid and substantially waterproof casing. The casing defines a casing external wall having a casing wall inner surface. The casing defines a filling aperture extending therethrough and a casing inner volume. The baseboard further has a filler. The method includes positioning the casing in a predetermined relationship relative to the building wall and filling the casing with the filler. The filler substantially contacts the casing wall inner surface for minimizing an amount of air between the filler and the casing external wall.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

In the appended drawings:

FIG. 23, in a perspective view, illustrates yet another alternative casing module;

FIG. 24, in a front elevation view, illustrates the casing modules of FIG. 23;

FIG. 25, in a side elevation view, illustrates the casing modules of FIG. 23;

FIG. 26, in a top plan view, illustrates the casing modules of FIG. 23;

DETAILED DESCRIPTION

Figure 1A:
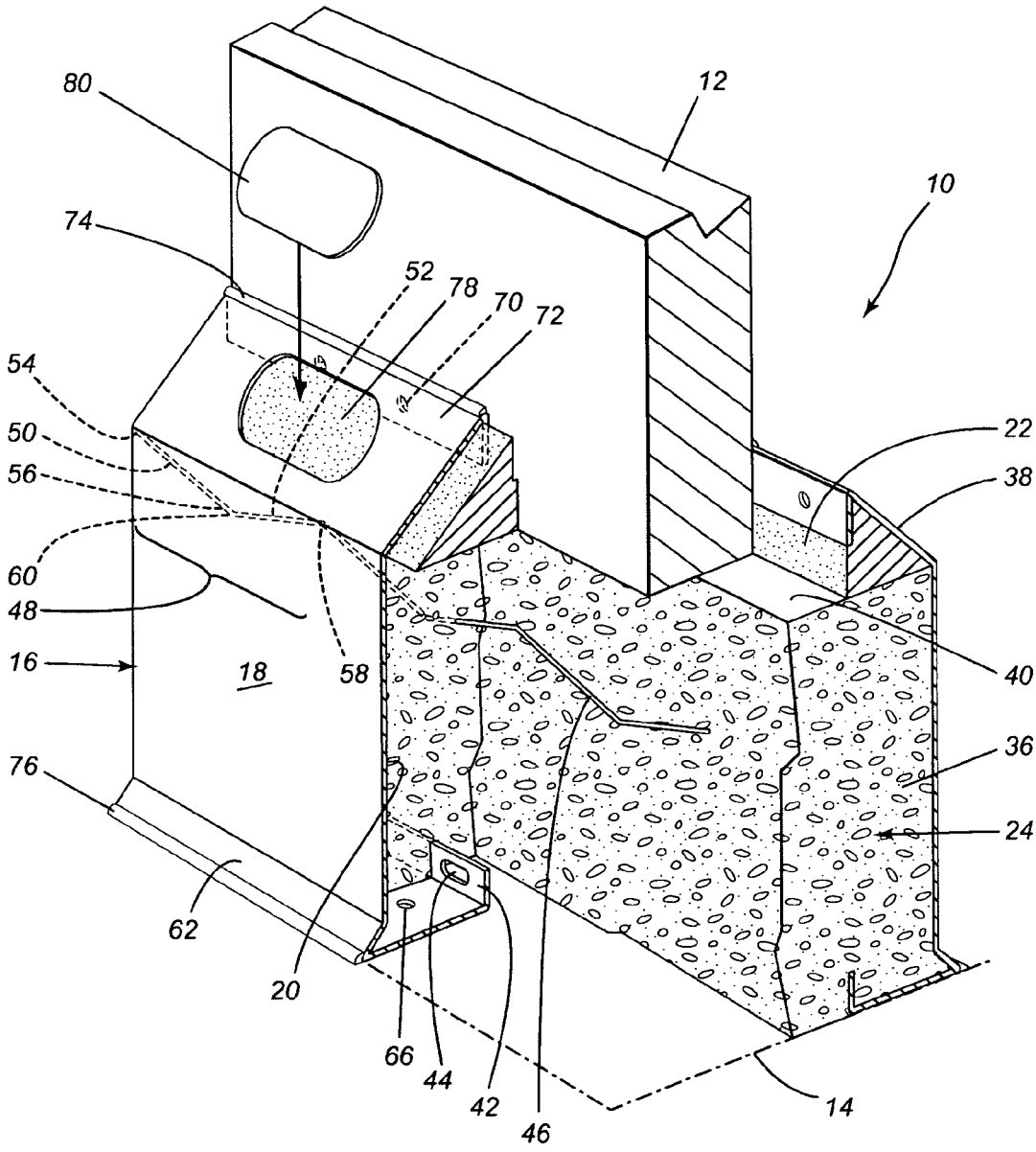
FIG. 1A, in a perspective view, illustrates a protective baseboard in accordance with an embodiment of the present invention, the protective baseboard being shown protecting a building wall in an industry requiring sanitary precautions.

FIG. 1A illustrates a protective baseboard 10 in accordance with an embodiment of the present invention. The protective baseboard 10 protects a building wall 12. In a specific embodiment of the invention, the protective baseboard 10 is usable in an industry requiring sanitary precautions. Such industries require that the presence some organisms, such as for example illness causing bacteria, among others, be controlled in a room. Non-limiting examples industries requiring sanitary precautions are: the food industry, the pharmaceutical industry, the health care industry, including hospitals and similar health care service points, among others.

However, the protective baseboard 10 is usable in any other industry wherein there is a need to build a protective baseboard. For example, and non-limitatively, the protective baseboard 10 is usable to build protective baseboards in parking lots.

The protective baseboard 10 is positionable substantially adjacent a ground surface 14 and includes a substantially rigid and substantially waterproof casing 16. The casing 16 defines a casing external wall 18, the casing external wall 18 having a casing wall inner surface 20. The casing 16 also defines a casing inner volume and a filling aperture 22 extending thereinto. The casing 16 is positionable in a predetermined relationship relative to the building wall 12.

A filler 24 is provided within the casing inner volume. The filler 24 substantially contacts the casing inner surface 20 for minimizing an amount of air between the filler 24 and the casing external wall 18.

Figure 1B:
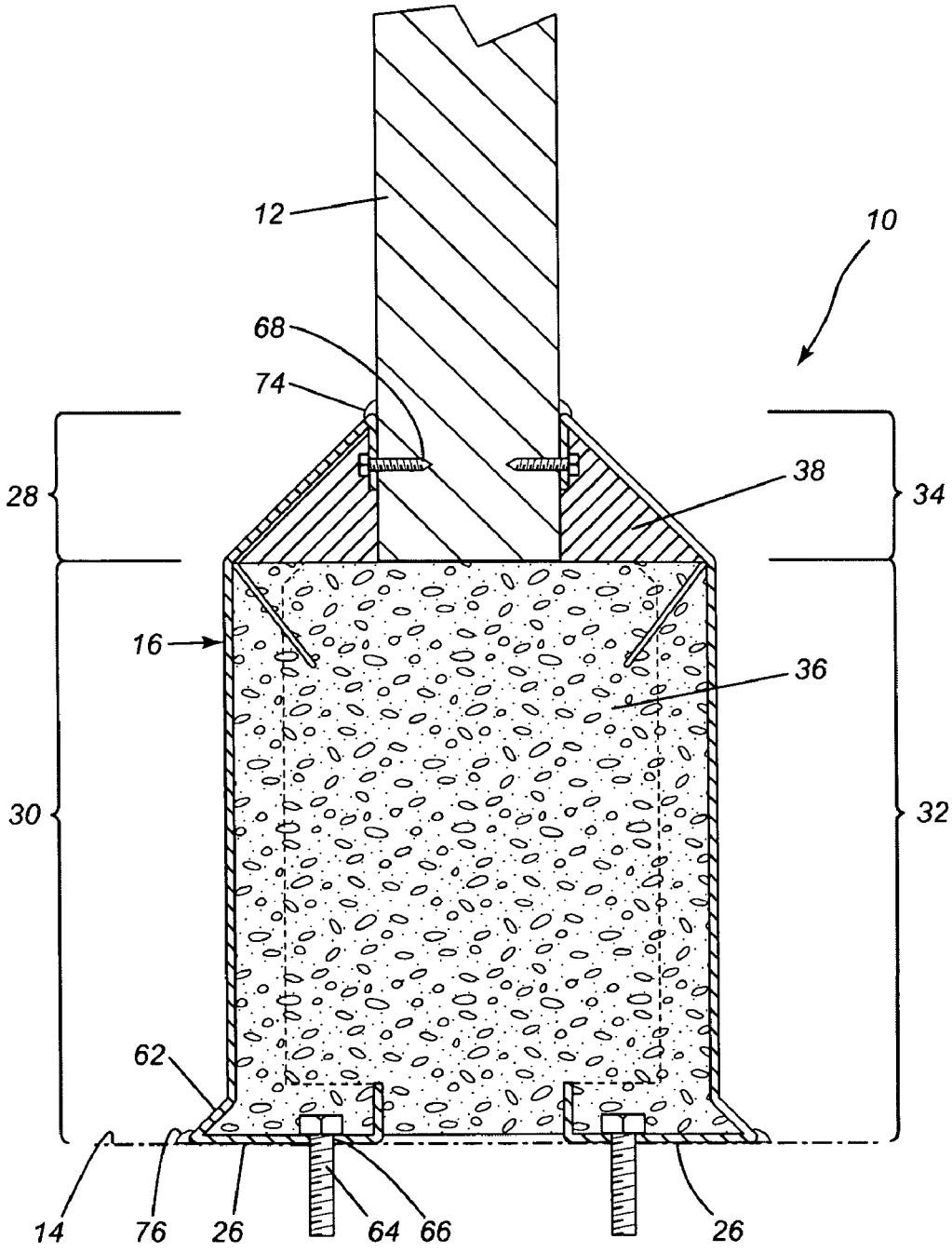
FIG. 1B, in a side cross sectional view, illustrates the protective baseboard of FIG. 1A.

As better illustrated in FIG. 1B, the casing 16 includes a casing base 26 positionable substantially adjacent the ground surface 14. The casing 16 further includes a casing upper portion 28 and a casing intermediate portion 30 extending between the casing base 26 and the casing upper portion 26.

The casing inner volume includes an inner volume first section 32 extending from the casing base 26 up to a baseboard first filling level, and a casing inner volume second section 34 extending from the baseboard first filling level up to a baseboard second filling level. The filler 24 includes a first filling material 36 filling the inner volume first section 32 and a second filling material filling the inner volume second section 34.

As shown in FIGS. 1A and 1B, in some embodiments of the invention, the first filling level is located substantially at the junction between the casing intermediate portion 30 and the casing upper portion 28. However, in alternative embodiments of the invention, the first filling level is any other suitable filling level.

Also, in FIGS. 1A and 1B, the second filling level is such that the casing inner volume is substantially entirely filled with the filler 24. In this case, there are substantially no air spaces between the filler 24 and the casing external wall 18. This is desirable as any air space has the potential to allow condensation within the protective baseboard 10. Such condensation provides a breeding ground for bacteria, which is highly undesirable in the food industry and in other similar industries wherein sanitary precaution requirements are relatively strict.

The reader skilled in the art will readily appreciate that in some embodiments of the invention, the filler includes only the first filling material. In these embodiments of the invention, a casing is relatively easily fillable with the first filling material while substantially avoiding the formation of air spaces within the casing inner volume.

In a specific embodiment of the invention, the first filling material 36 includes a pourable material. An example of such a pourable material is concrete. The use of concrete is advantageous as concrete is relatively robust and relatively inexpensive. Therefore, the protective baseboard 10 may include concrete filling at least in part the casing 16, the concrete reinforcing the casing 16 at a relatively low cost.

In a specific embodiment of the invention, the second filling material 38 includes an expandable material. The use of an expandable material helps in ensuring there are substantially no air spaces left within the casing upper portion 28. When the expandable material is inserted within the casing 16, the expandable material chases the air contained within the casing while it fills the casing 16.

Furthermore, in some embodiments of the invention, the expandable material is also injectable. The use of an injectable material allows to relatively easy introduce the expandable material within the casing 16 through injection. An example of a suitable material is an expandable foam.

While specific examples of first and second filling materials 36 and 38 have been given hereinabove, the reader skilled in the art will readily appreciate that alternative suitable first and second filling materials 36 and 38 are within the scope of the invention.

In some embodiments of the invention, the casing external wall 18 includes stainless steel. Stainless steel is advantageous in some embodiments of the invention as it is waterproof, thereby protecting the filler 24 from water infiltration. Such water infiltrations could occur when the protective baseboard 10 is washed if another non-suitable substance were used in the casing external wall 18. In addition, stainless steel is relatively inert. Stainless steel is commonly used in the food industry because of these properties, among other advantageous properties of this material.

As better seen in FIG. 1A, the first filling material 36 defines a resting surface 40 allowing the building wall 12 to sit thereon. The second filling material 38 is positionable so as to be in substantially lateral contact with the building wall 12.

Figure 2A:
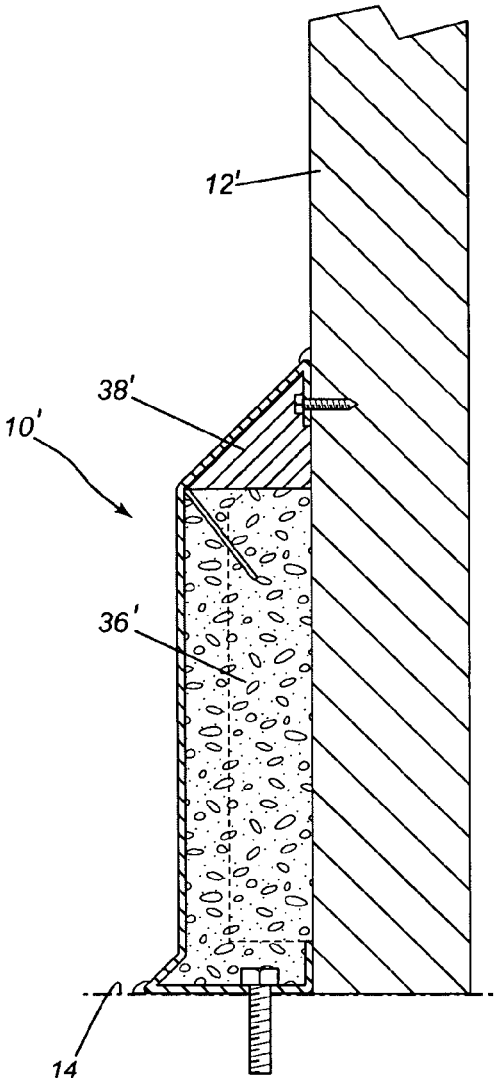
FIG. 2A, in a side cross sectional view, illustrates a protective baseboard in accordance with an alternative embodiment of the present invention, the protective baseboard being shown protecting a building wall in an industry requiring sanitary precautions.

This embodiment of the invention is useful when assembling a new partition within a factory. However, in cases wherein it is required that the protective baseboard be installed in proximity to an already existing wall that extends down to the ground surface 14, the embodiment of the invention shown in FIG. 2A may be more suitable used.

In this latter embodiment of the invention, an alternative protective baseboard 10' is provided for protecting an alternative building wall 12'. This alternative baseboard 10' is similar to the protective baseboard 10, except that in this embodiment of the invention, the building wall 12' extends from the ground surface 14. In this embodiment of the invention, both first and second filling materials 36', 34' are positionable so that they are in substantially lateral contact with the building wall 12'.

Figure 2B:
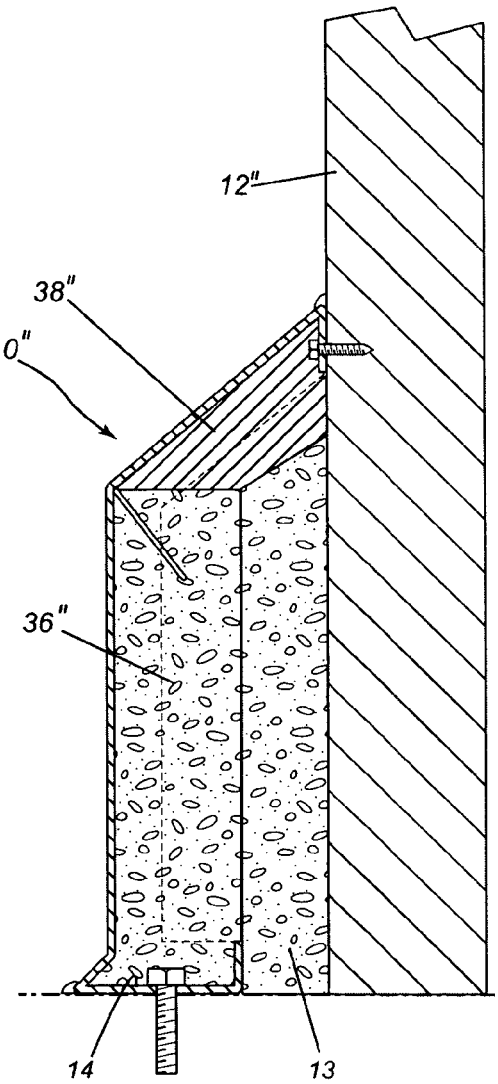
FIG. 2B, in a side cross sectional view, illustrates a protective baseboard in accordance with another alternative embodiment of the present invention, the protective baseboard being shown protecting a building wall in an industry requiring sanitary precautions.

FIG. 2B also illustrate an alternative baseboard 10" particularly useful for protecting an alternative building wall 12" that includes an already existing protective baseboard 13 extending therefrom. The protective baseboard 14 may, for example, be in a prior art baseboard as the prior art baseboard described in the background of the present document. In the protective baseboard 10", as in the protective baseboard 10', first and second filling materials 36", 34" are positionable so that they are in substantially lateral contact with the building wall 12", and more particularly, so that they are in lateral contact with any portion with the existing baseboard 13 enclosed within the protective baseboard 10".

In this embodiment of the invention, the protective baseboard 10" may be used to repair an already existing baseboard 13 without requiring that such an existing baseboard be removed from the factory into which it is already present.

In some embodiments of the invention, the casing 16 includes an anchoring component extending substantially inwardly within the inner volume first section. The anchoring component is embedded within the first filling material 36.

As shown in FIG. 1A, in some embodiments of the invention, the anchoring component includes an anchoring strip 42 extending from the casing base 26. The anchoring strip 42 includes an aperture 44 extending therethrough, the aperture 44 being substantially filled with the first filling material 36. In some embodiments of the invention, a similar anchoring strip does not include any aperture. Also, in other embodiments of the invention, a similar anchoring strip includes more than one aperture extending therethrough.

In another example, the anchoring component includes an anchoring rod 46 extending from the casing external wall 18. The anchoring rod 46 includes a substantially V-shaped portion 48 including first and second substantially elongated segments 50 and 52.

The first segment 50 defines a first segment first end 54 and a substantially longitudinally opposed first segment second end 56. Similarly, the second segment 52 defines a second segment first end 58 and a longitudinally opposed second segment second end 60. The first segment second end 56 is linked to the second segment second end 60. The first and second segments first ends 54 and 58 extend from the casing intermediate portion 30.

In the embodiment of the invention shown in FIGS. 1A and 1B, the first and second segments first ends 56 and 60 extend from the casing intermediate portion 30 substantially adjacent to the first filling level. However, in other embodiments of the invention, the first and second segments 50 and 52 are provided within the casing 16 at any other suitable location.

Although specific example of anchoring components have been described hereinabove, the reader skilled in the art will readily appreciate that it is within the scope of the invention to have protective baseboards including any other suitable occurring component.

The anchoring components help to maintain the filler 24 and the casing 16 substantially immobile with respect to each other. This reduces the possibility that the filer 24 delaminates from the casing 16, which could cause the formation of air spaces between the filler 24 and the external wall 18. As mentioned hereinabove, this is regarded typically as an undesirable result in the industries requiring sanitary precautions.

As better shown in FIG. 1B, in some embodiments of the invention, the casing upper section 28 is angled with respect to a horizontal plane at an upper section-to-horizontal direction angle. For example, in some embodiments of the invention, the upper section-to-horizontal direction angle is at least about 45°. Also, in some embodiments of the invention, the casing intermediate section 30 is substantially vertical.

This configuration helps in minimizing risks that an object could be inadvertently forgotten onto the protective baseboard 10 and thereafter accidentally fall to an undesirable location. A non-limiting example of an undesirable location includes a food container into which food is stored. In this case, if for example a knife fell into a food container, there could be a potential danger to customers of the factory as the knife may contaminate the food with bacteria or may hurt a user manipulating the food into which the knife has fallen.

In some embodiments of the invention, the casing base 26 defines a substantially outwardly extending lip 62. The lip 62 helps in directing liquid that may fall from the protective baseboard 10 substantially away from the protective baseboard 10. For example, in the food industry, it is common to wash walls and protective baseboards using water or cleaning solutions. Directing these liquids away from the protective baseboard 10 helps in avoiding the presence of stagnant water in proximity to the baseboard 10, which may promote bacterial growth inside a room into which the protective baseboard 10 is installed. However, in some embodiments of the invention the lip 62 is not required and may be omitted.

In some embodiments of the invention, the protective baseboard 10 includes a ground attachment for securing the casing 16 to the ground surface. For example, the ground attachment includes a bolt 64 extending through a ground attachment aperture 66 provided through the casing base 26. However, it is within the scope of the invention, to secure the casing 16 to the ground surface 14 in any other suitable manner.

Similarly, in some embodiments of the invention, a wall attachment is provided for securing the casing 16 to the building wall 12. For example, the casing upper portion 28 includes a wall contacting portion 72 through which a wall attachment aperture 70 extends. The wall contacting portion 72 is substantially parallel to the building wall 12 and directed substantially inwardly within the casing inner volume. The wall attachment includes a bolt 68 inserted into the wall attachment aperture 70. The reader skilled in the art will readily appreciate that it is also within the scope of the invention to have protective baseboard that include only ground attachment, only wall attachments, or neither wall attachment nor the ground attachment.

In some embodiments of the invention, the protective baseboard 10 includes an upper sealing strip 74 extending between the casing upper portion 28 and the building wall 12. Also, in some embodiments of the invention, the protective baseboard 10 includes a base sealing strip 76 extending between the casing base 26 and the ground surface 14. For example, the base ceiling strip extends between the lip 72 and the ground surface 14. For example, the upper and lower ceiling strips 74 and 76 include a silicone.

The upper and lower sealing strips 74 and 76 help in ensuring that water infiltrations within the protective baseboard 10 are minimized. As described hereinabove, water infiltrations are regarded as undesirable in many settings as they may promote bacterial growth.

Figure 27:
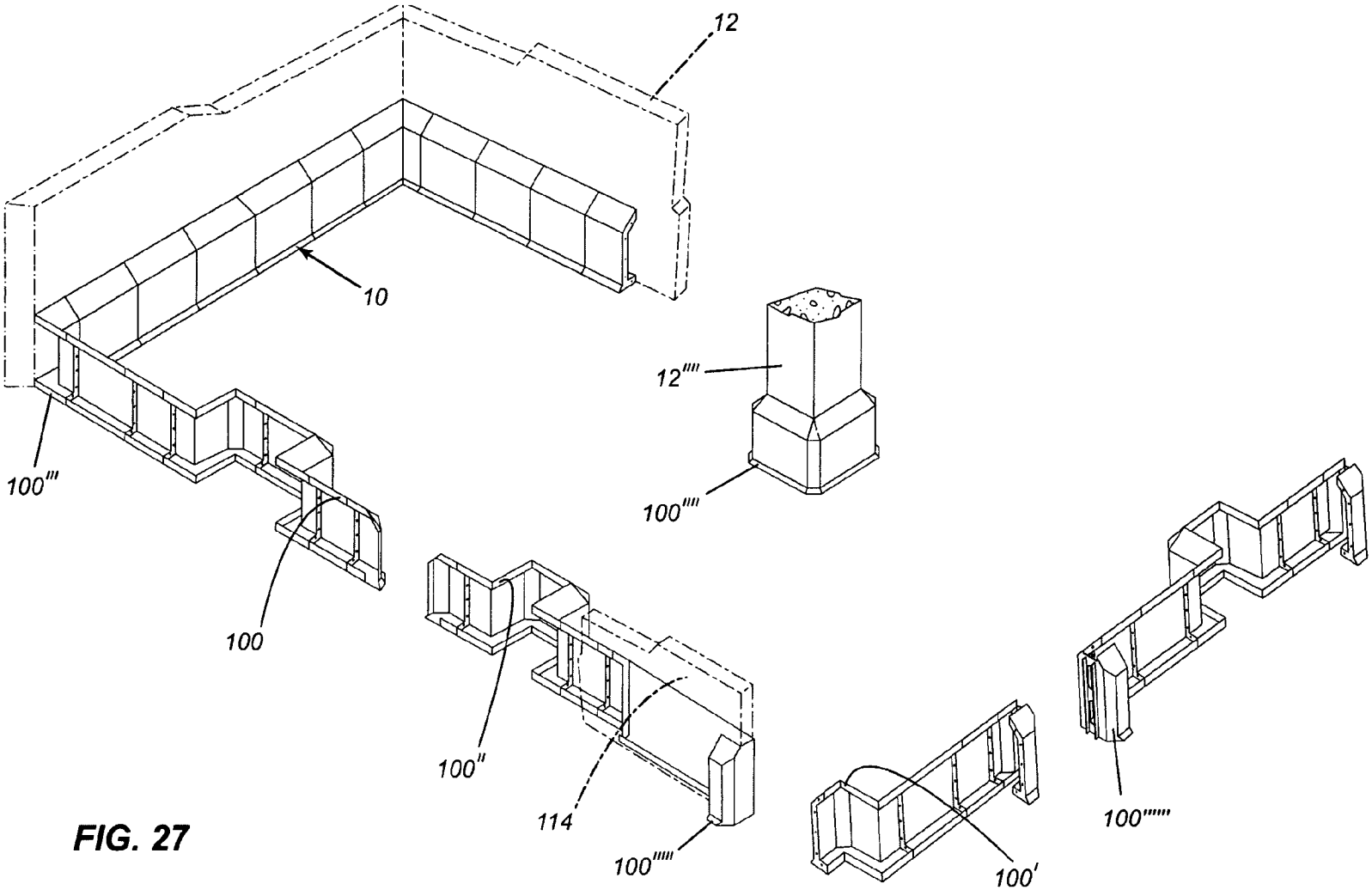
FIG. 27, in a perspective view, illustrates a casing including the casing modules of FIGS. 3 through 26.

As shown in FIG. 27, in some embodiments of the invention, the protective baseboard 10 is assembled through the use of at least two casing modules. However, in other embodiments of the invention the protective baseboard 10 does not include modules.

Figure 3:
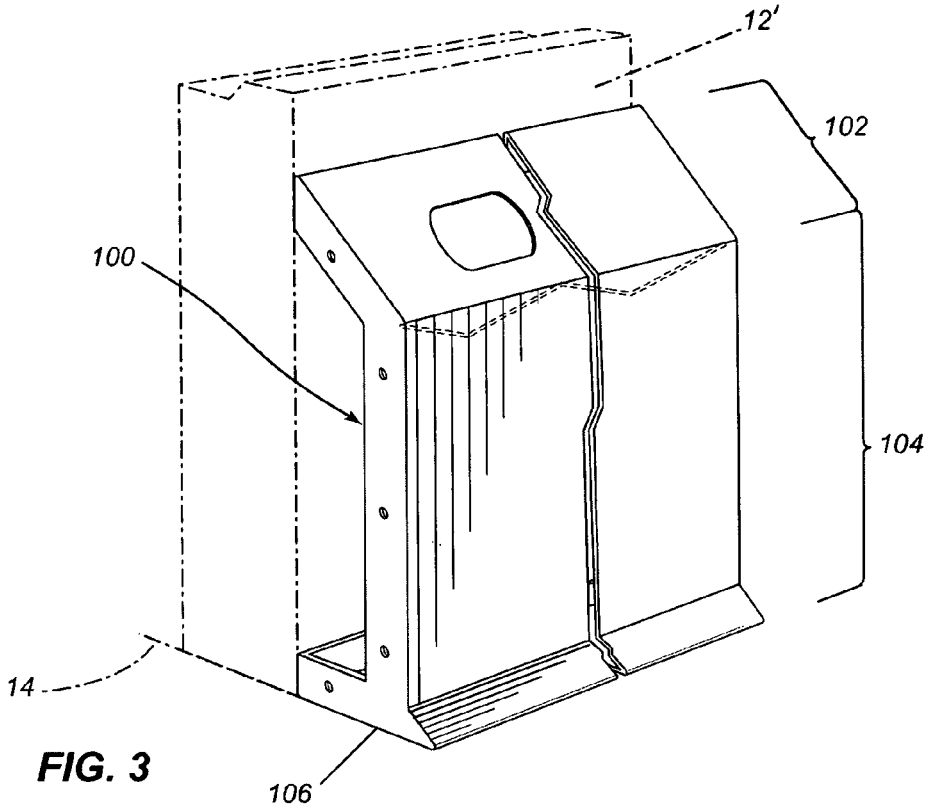
FIG. 3, in a perspective view, illustrates a casing module included in the protective baseboard of FIG. 1A.
Figure 4:
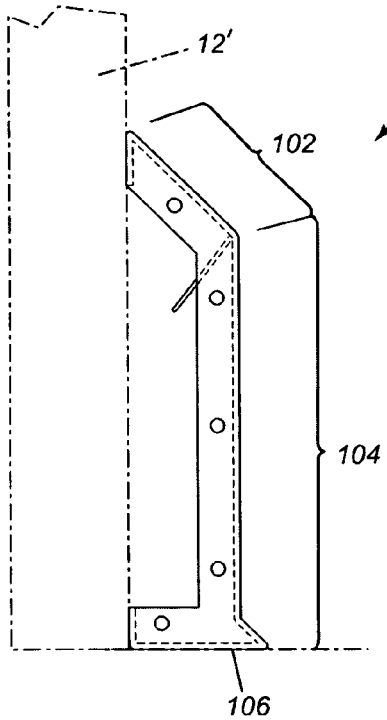
FIG. 4, in a side elevation view, illustrates the casing module of FIG. 3.
Figure 5:
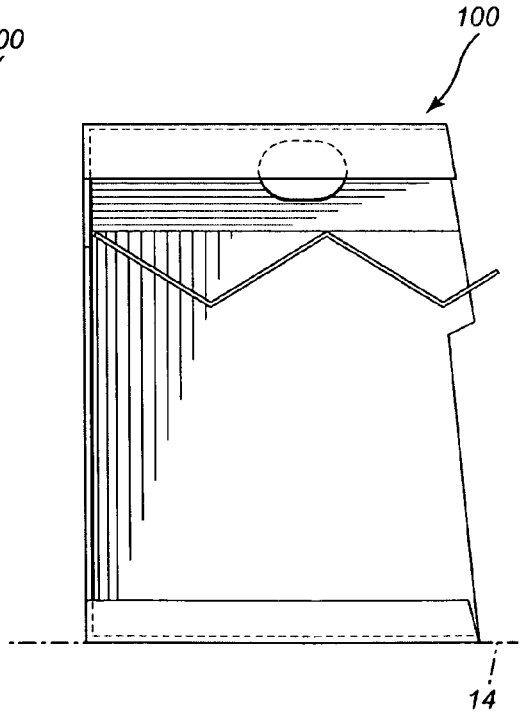
FIG. 5, in a rear elevation view, illustrates the module of FIG. 3.

FIGS. 3, 4, and 5 illustrate a casing module 100 of a first type. The casing module 100 is postionable substantially adjacent to the ground surface 14 (not shown in FIG. 5). The casing module 100 includes a casing module upper portion 102, a casing module base 106 positionable substantially adjacent the ground surface 14, and a casing module intermediate portion 104 extending between the casing module base 106 and the casing module upper portion 102. The casing module upper portion, intermediate portion and base 102, 104 and 106 form respectively a portion of the casing upper portion 28, the casing intermediate portion 30 and the casing base 26.

Figure 13:
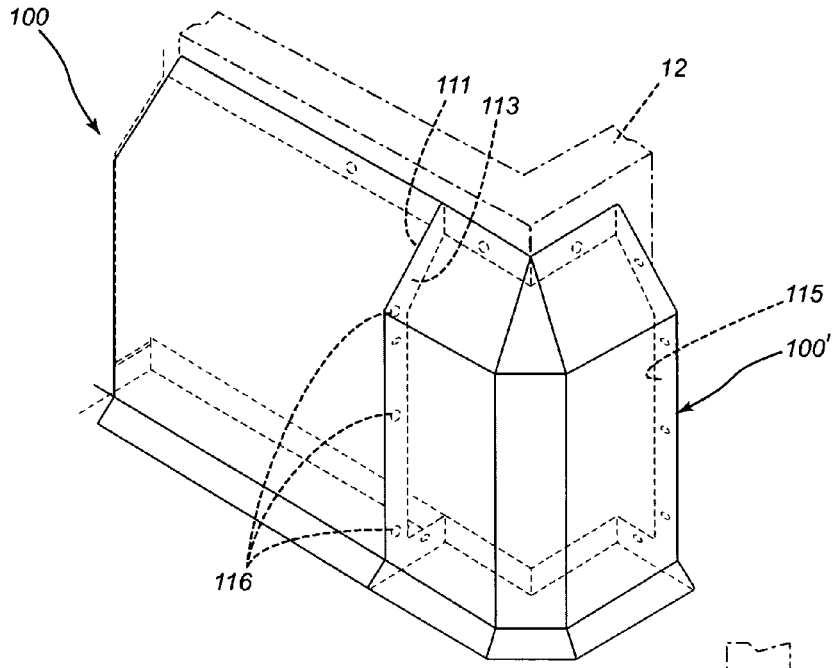
FIG. 13, in a perspective view, illustrates yet another alternative casing module welded to the casing module of FIG. 6.
Figure 15:
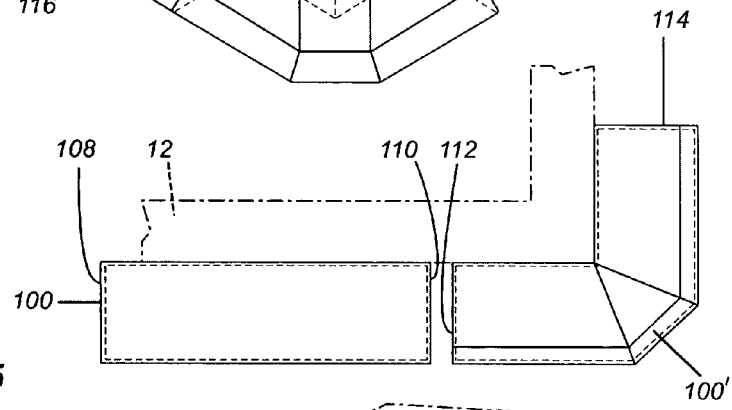
FIG. 15, in a front elevation view, illustrates the casing modules of FIG. 13.
Figure 14:
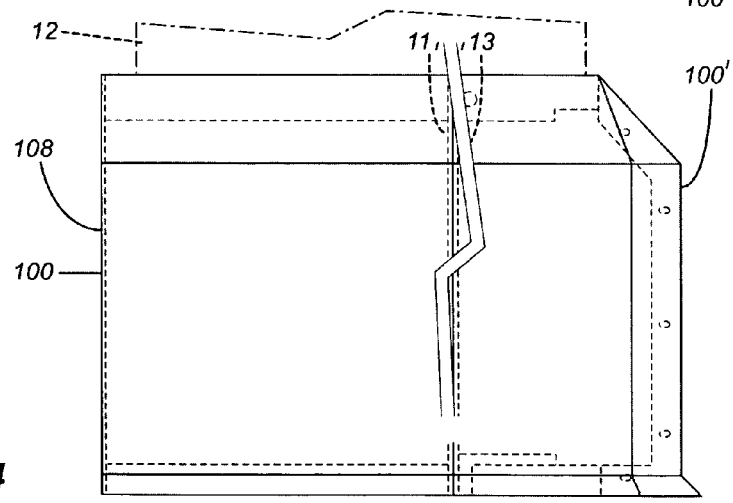
FIG. 14, in a top plan view, illustrates the casing modules of FIG. 13.

FIGS. 13, 15 and 14, illustrate an example of a manner of linking modules to form the casing 16. In FIGS. 13, 15 and 14, the casing module 100 is linked to an alternative casing module 100'.

The casing module 100' is similar to the casing module 100, except that a casing module 100' is not substantially rectilinear as is the casing module 100 but is instead substantially V-shaped. The casing module 100' is typically useful, for example for conforming to external right angles into the building wall 12.

The casing module 100 defines a first casing module first end 108 and a first casing module second end 110, substantially longitudinally opposed to the first casing module first end. Similarly, the casing module 100' defines a second casing module first end 112 substantially longitudinally opposed second casing module second end 114. For the purpose of this description, the term longitudinal refers to a direction substantially parallel to the ground surface 14 that conforms to the shape of the building wall 12. The first casing module second end 110 is linked to the second casing module first end 112.

For example, in some embodiments of the invention, the first casing module second end 110 is welded to the second casing module first end 112. In some embodiments of the invention, the first casing module second end 110 is welded to the second casing module first end 112 through tacks 116. The use of tacks 116 allows to relatively easily link the casing modules 100 and 100' to each other on a construction site in a relatively short amount of time. However, in other embodiments of the invention, the first casing module second end 110 is welded to the second casing module first end 112 in any other suitable manner. In yet other embodiments of the invention, the first casing module second end 110 is linked to the second casing module first end 112 in any other suitable manner.

As better shown in FIG. 13, in some embodiments of the invention, the first and second modules first and second ends each include a respective flange 109, 111, 113 and 115. The flanges 109, 111, 113 and 115 extend substantially inwardly into the casing 16 from the casing external wall 18. The flanges 109, 111, 113 and 115 substantially rigidify the casing 16 and help to link the casing modules 100 and 100' as they add material at locations at which the tacks 116 are applied.

Figure 10:
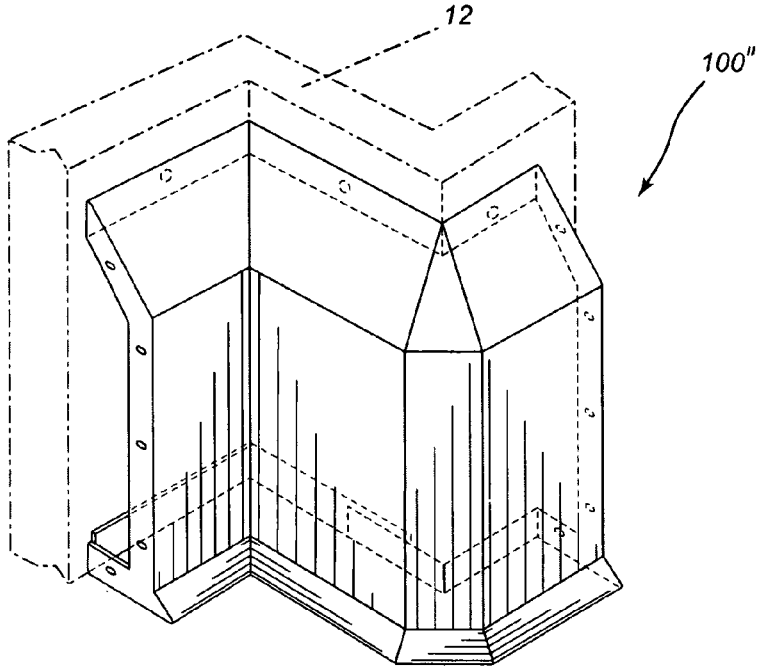
FIG. 10, in a perspective view, illustrates another alternative casing module.
Figure 12:
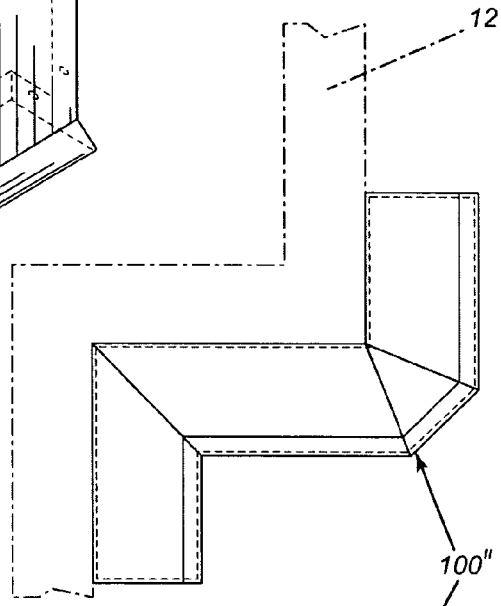
FIG. 12, in a side elevation view, illustrates the casing module of FIG. 10.
Figure 11:
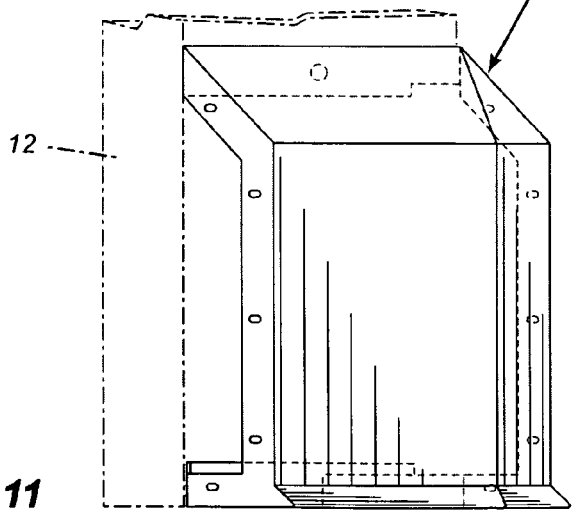
FIG. 11, in a top plan view, illustrates the casing module of FIG. 10.

FIGS. 11, 10 and 12 illustrate another alternative module 100" usable in portions of the building wall 12 wherein an inner right angle and an outer right angle are provided in proximity to each other, the module 100" substantially conforming to the shape of the building wall 12.

Figure 16:
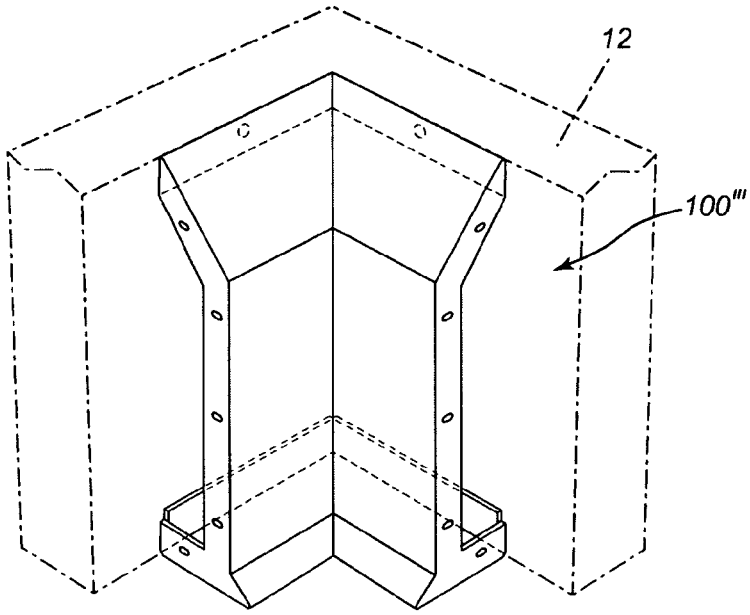
FIG. 16, in a perspective view, illustrates yet another alternative casing module.
Figure 18:
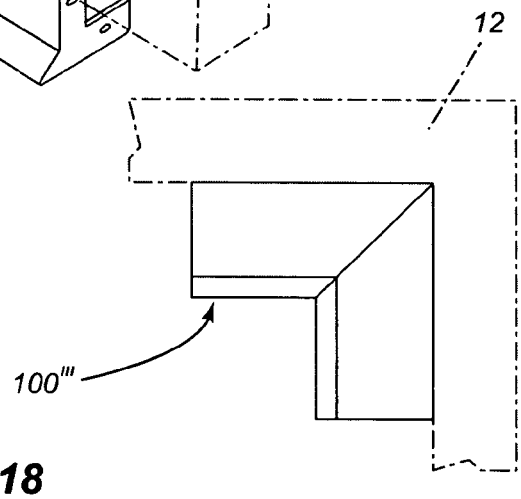
FIG. 18, in a top plan view, illustrates the casing modules of FIG. 16.
Figure 17:
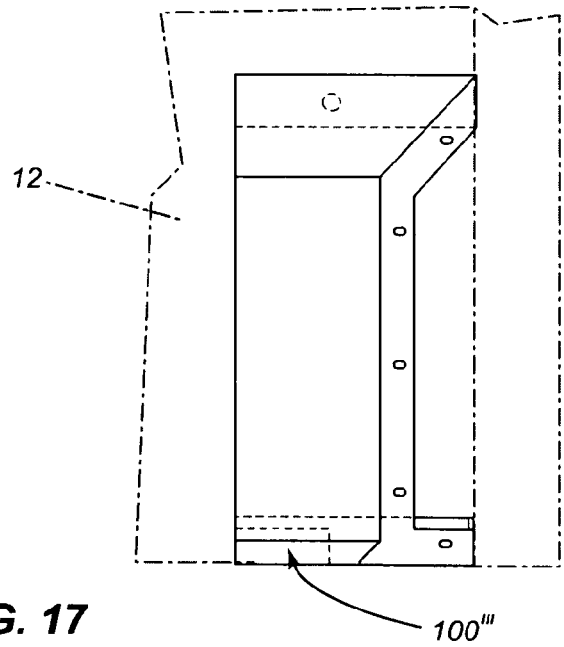
FIG. 17, in a front elevation view, illustrates the casing modules of FIG. 16.
Figure 19:
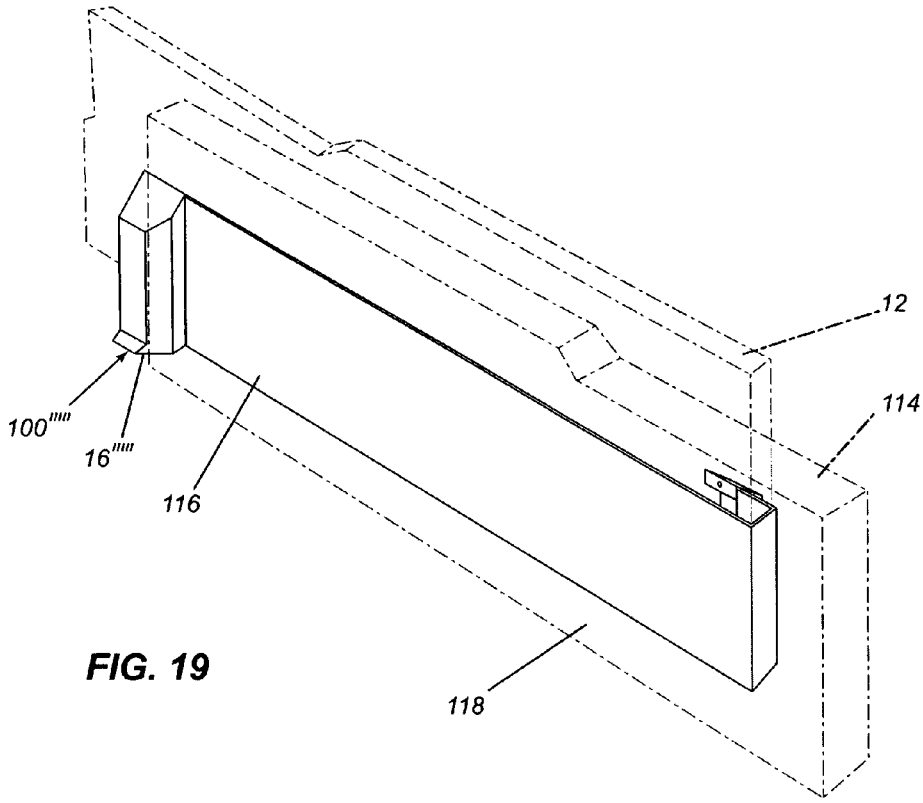
FIG. 19, in a perspective view, illustrates yet another alternative casing module defining a recess for receiving a sliding door.
Figure 22:
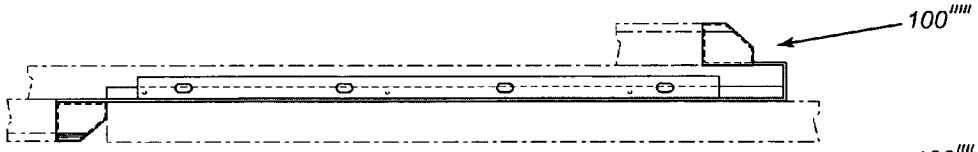
FIG. 22, in a top plan view, illustrates the casing modules of FIG. 19.
Figure 20:
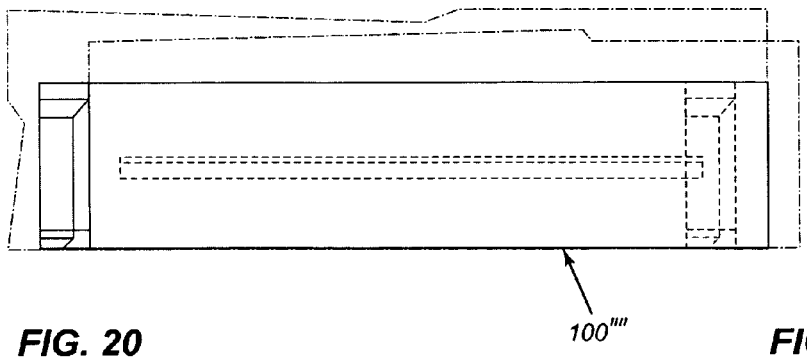
FIG. 20, in a front elevation view, illustrates the casing modules of FIG. 19.
Figure 21:
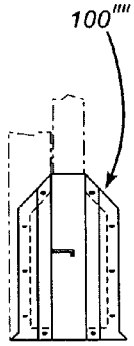
FIG. 21, in a side elevation view, illustrates the casing modules of FIG. 19.

FIGS. 16, 17 and 18 illustrate yet another alternative casing module 100''' usable in regions of the building wall 12 defining an inner right angle, the module 100''' substantially conforming to the shape of the building wall 12.

FIGS. 23, 24, 25 and 26 illustrate yet another alternative casing module 100'''' usable in regions wherein the wall defines two substantially adjacent external right angles, the module 100'''' substantially conforming to the shape of the wall. For example, the module 100'''' is usable in regions wherein the wall takes the form of a column 12'''' (only part of which is shown in FIGS. 23-26). The reader skilled in the art will readily appreciate that the column 12'''' is not necessarily adjacent any other portion of the building wall 12 and maybe, for example, a column 12'''' present within a room into which the protective baseboard 10 is installed.

FIGS. 19, 20, 21 and 22 illustrate yet another baseboard module 100'''''. The baseboard module 100''''' is positionable substantially adjacent to a sliding door 114. The protective baseboard 10 is interrupted so as to define a door receiving space 118 adapted to receive the sliding door 114 door slidably therein. The baseboard module 100''''' includes a plate 116 extending longitudinally therefrom, the plate 116 being adapted to be positioned substantially adjacent the building wall 12 so as to be interposed between the building wall 12 and the sliding door 114 and to allow a movement of the sliding door 114 relatively to the building wall 12. Therefore, the module 100''''' is suitable, for example, for protecting the building wall 12 substantially adjacent the sliding door 114.

Figure 6:
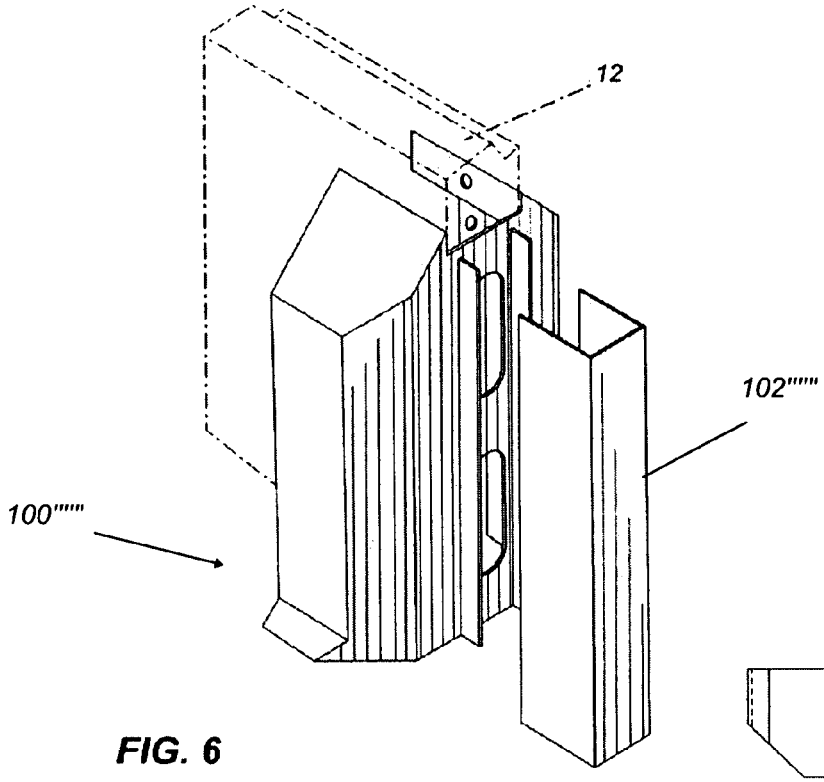
FIG. 6, in a perspective view, illustrates an alternative casing module.
Figure 9:
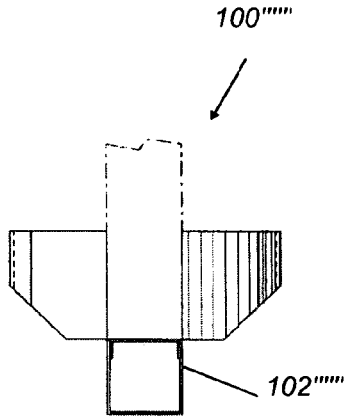
FIG. 9, in a top plan view, illustrates the casing module of FIG. 6.
Figure 7:
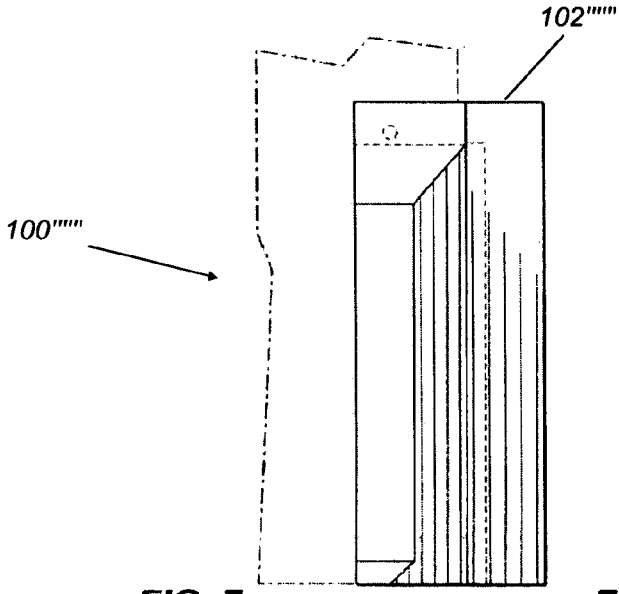
FIG. 7, in a side elevation view, illustrates the casing module of FIG. 6.
Figure 8:
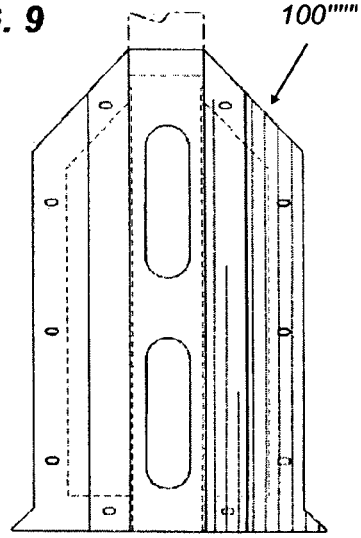
FIG. 8, in a front elevation view, illustrates the casing module of FIG. 6.

FIGS. 6, 7, 8 and 9 illustrate yet another alternative module 100"""" usable in portions of the building wall 12 substantially adjacent a door, such as the sliding door 114 (not shown in FIGS. 6, 7, 8 and 9). As better seen in FIG. 27, the module 100"""" is positionable substantially adjacent interruptions in the protective baseboard 10 providing openings that are selectively blocked by the door. Referring to FIG. 6, the module 100"""" includes a flange 102"""" extending substantially outwardly therefrom and positionable into the opening. The flange 102"""" helps in sealing the opening with the door to minimize the passage of air therethrough.

Turning back to FIG. 1A, in some embodiments of the invention, the casing 16 includes an upper aperture 78 provided within the casing upper portion 28. The upper aperture 78 serves many purposes. For example, the upper aperture 78 allows pouring of the concrete 36 in embodiments of the invention wherein the protective baseboard is the protective baseboard 10' provided substantially adjacent an existing wall. Therefore, the upper aperture 78 in this case is a pouring aperture.

Also, the upper aperture 78 allows the injection of the foam 38 within the casing upper portion 28. In this case, the upper aperture 78 serves as an injection aperture. Furthermore, the upper aperture 78 allows access to the attachment apertures 70 and 66, thereby allowing an intended user to secure the casing 16 to the building wall 12 or to the ground surface 14 even if the aperture 66 and 70 are not accessible otherwise.

In some embodiments of the invention, the upper aperture 78 is coverable with a cover 80. The cover 80 is, for example, positionable substantially in register with the upper aperture 78 after the second filling material 38 has been provided within the casing upper section 28. The cover 80, for example, may be secured within the upper aperture 78 with silicone.

The reader skilled in the art will readily appreciate that in some embodiments of the invention, the upper aperture 78 is not provided. In some of these embodiments of the invention, the filling aperture 22 is usable for pouring the concrete 36 into the casing 16 and injecting the foam 38 within the casing upper portion 28

Figure 28:
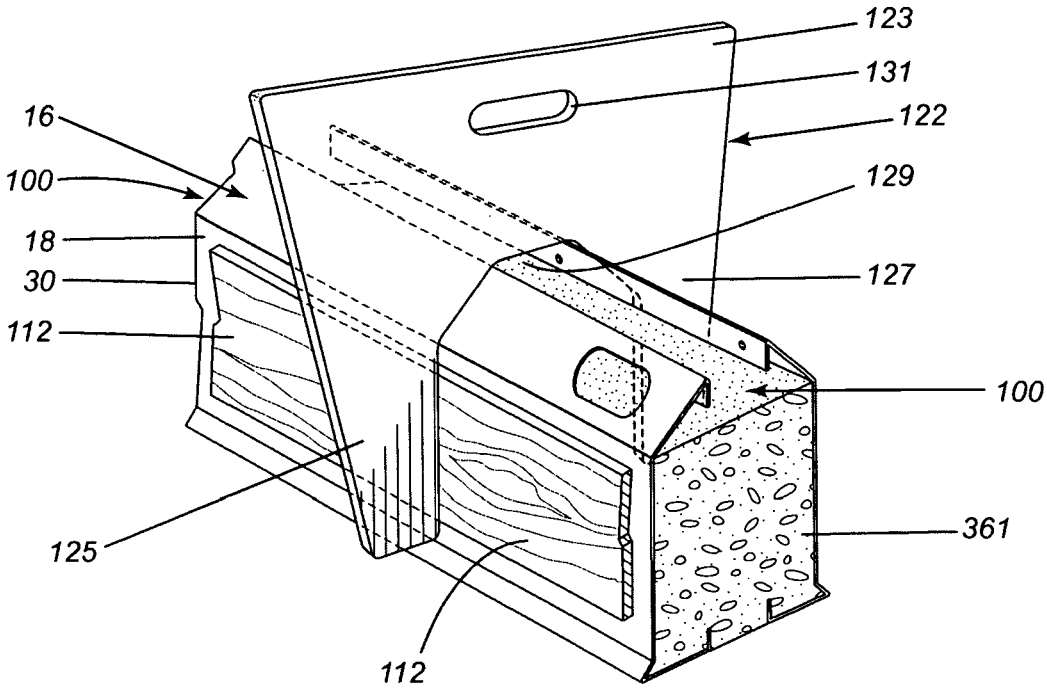
FIG. 28, in a perspective view, illustrates a retaining component of a first type and a board retaining the casing of FIG. 1.
Figure 29:
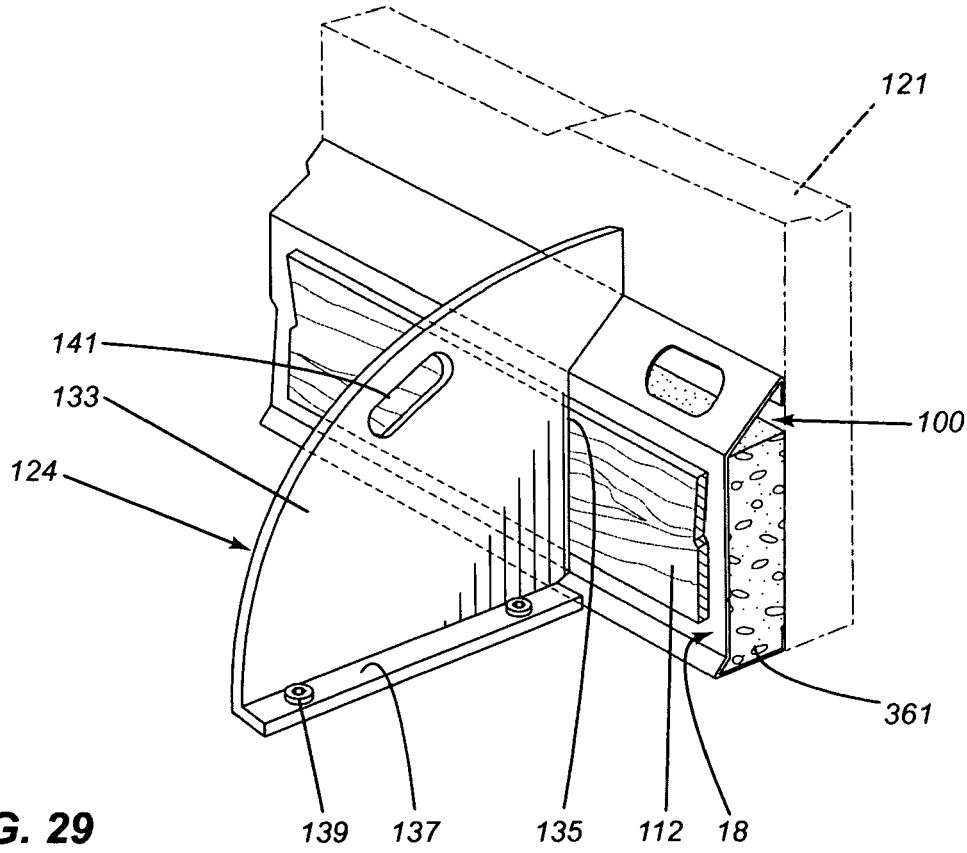
FIG. 29, in a perspective view, illustrates a retaining component of a second type and a board retaining the casing of FIG. 1.

FIGS. 28 and 29 illustrate the use of a temporary formwork to reinforce the casing 16. The temporary formwork includes one or more boards 112 and one ore more retaining components of first and second types 122 and 124. In alternative embodiments of the invention, a temporary formwork does not include boards 112, retaining components of the first type 122 or retaining component of the second type 124.

The boards 112 abut the casing intermediate portion 30 and are useful both for reinforcing the casing 16 and for protecting the casing external wall 18 against damages that may be caused by the retaining components of first and second types 122 and 124. For example, but non-limitatively, the boards 112 are plywood boards.

The retaining component of the first type 122 is substantially planar and substantially U-shaped and includes a first retaining component body 123 and two retaining component legs 125 and 127 extending therefrom. In some embodiments of the invention, the first retaining component body 123 defines a handle 131 in the form of an aperture extending therethrough.

The retaining component legs 125 and 127 define a retaining component recess 129 extending therebetween for receiving thereinto two casing modules 100 positioned in a spaced apart relationship relative to each other. The boards 112 are provided between the retaining component legs 125 and 127 and the casing modules 100.

The retaining component of the second type 124 includes a substantially flat second retaining component body 133 having a board contacting side 135 and a floor anchoring flange 137 substantially perpendicular to the board contacting side 135. The floor anchoring flange 137 is positionable substantially adjacent a ground surface and includes ground anchoring components 139 for securing the retaining component of the second type 124 to a floor. In some embodiments of the invention, the second retaining component body 133 defines a handle 141 in the form of an aperture extending therethrough.

The retaining component of the second type 124 transmits forces applied thereon by the casing 16 to the ground surface 14. Suitably securing the retaining component of the second type 124 to the ground surface 14 insures that movements of the casing 16 relative to the building wall 12' are minimized.

The retaining components of the first and second types 122 and 124 are manufactured using any suitable material, such as for example steel. The retaining component of the first and second types 122 and 124, along with the boards 112, substantially prevent the casing modules 100 to be spread apart from each other under the weight of the first filling material 36 if the first filling material is relatively dense and pourable.

While many features of protective baseboard 10 have been described hereinabove, the reader skilled in the art will readily appreciate that some of these features are not necessarily present in all embodiments of the invention.

Figure 30:
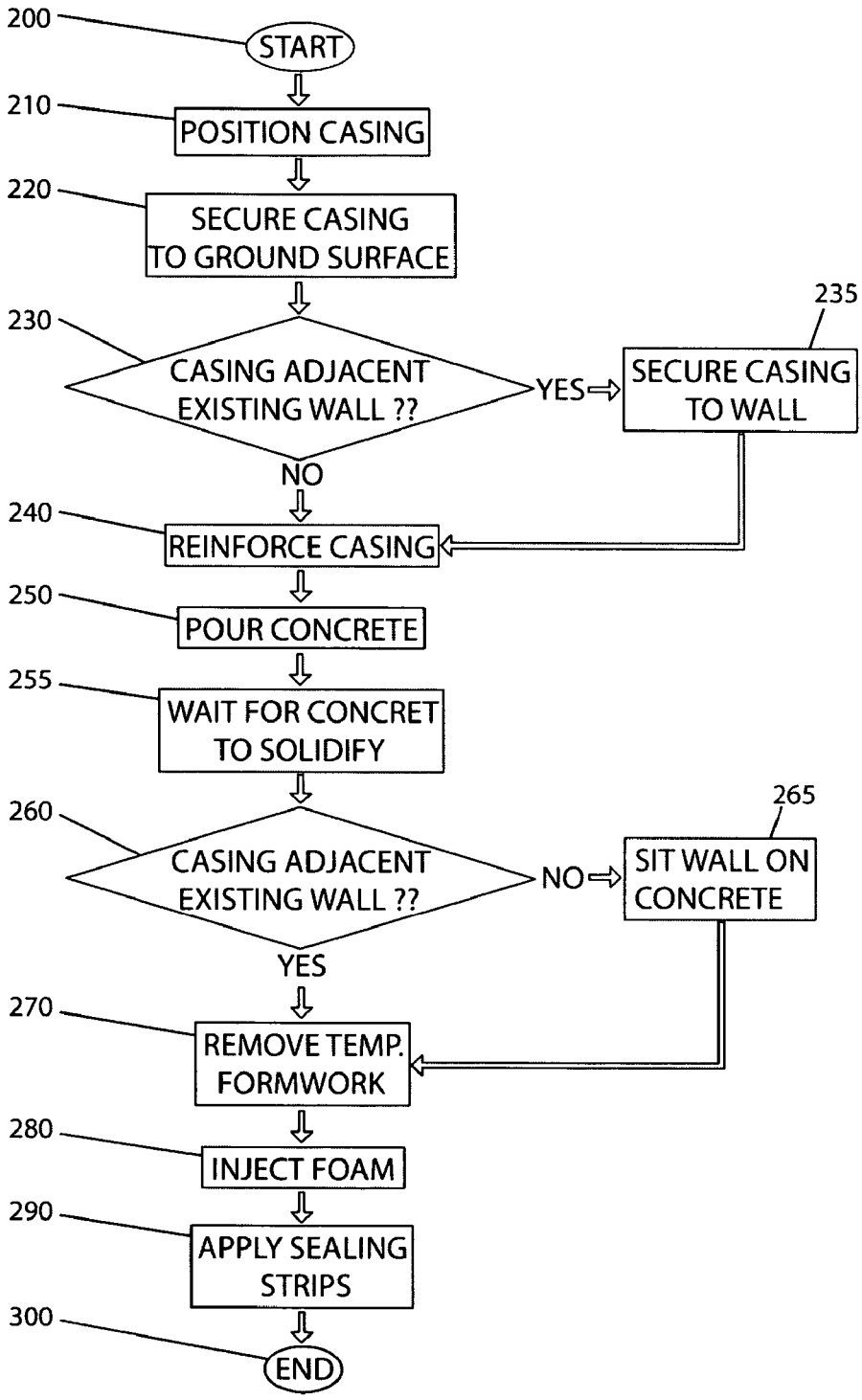
FIG. 30 is a flowchart illustrating a method for building a protective baseboard.

A method for building a protective baseboard similar to the protective baseboard 10 is now described in further details with reference to FIG. 30. This method is described in a case wherein the first filling material 36 is concrete, the second filling material 38 is an expandable and injectable foam, and the upper and base sealing strips 74 and 76 are provided. However, the reader skilled in the art will readily appreciate that similar methods are applicable in cases wherein the sealing strips 74 and 76 are not provided or in cases wherein the first and second filling materials 36 and 38 differ from concrete and foam.

The method starts at Step 200. At Step 210, the casing 16 is positioned. This Step also includes securing modules, such as for example modules 100, 100', 100", 100''', 100"" and 100""" to each other in any suitable manner, for example through the use of welding tacks.

At Step 220, the ground attachments are used to secure the casing 16 to the ground surface 14. Then, Step 230 proposes an alternative according to whether the casing 16 is adjacent an existing building wall 12' or not. If the casing 16 is adjacent an existing building wall 12', at Step 235, the casing 16 is secured to the building wall 12 using the wall attachments. Then, the method jumps to Step 240. If the casing is not adjacent an existing wall, the method jumps directly to Step 240.

At Step 240, the casing 16 is reinforced using the boards 112 and the first and second type of retaining components 122 and 124, as described hereinabove.

Subsequently, the concrete is poured into the casing 18 at Step 250 and left to solidify at least in part at Step 255. The reader skilled in the art will readily appreciate that it is not necessarily required that solidification of the concrete be totally completed prior to performing the following Steps. Indeed, since the casing 16 remains in place when the protective baseboard 10 is finished being built, the concrete may keep on solidifying even while the protective baseboard 10 is used during normal operation of the room into which it is installed.

Subsequently, at Step 260, an alternative is provided according to whether the casing 16 is erected adjacent an existing building wall 12' or not. If the casing 16 was not positioned adjacent an existing building wall 12', the building wall 12 is positioned so that the building wall 12 sits on the concrete. This is performed at Step 265. Subsequently, the method jumps to Step 270. In a case wherein the casing was positioned adjacent an existing building wall 12', the method jumps directly to Step 270.

At Step 270, the temporary formwork is removed. The reader skilled in the art will readily appreciate that in some embodiments of the invention removal of the temporary formwork may occur at other times during the method, for example, prior to positioning the building wall 12 on the concrete. Then, the foam is injected into the casing upper section 28 at Step 280. Finally, ceiling strips 76 and 78 are applied at Step 290 and the method ends at Step 300.

Although the present invention has been described hereinabove by way of preferred embodiments thereof, it can be modified, without departing from the spirit and nature of the subject invention as defined in the appended claims.

What is claimed is:

1. A protective baseboard for protecting a building wall in an industry requiring sanitary precautions, said protective baseboard being positionable substantially adjacent a ground surface, said protective baseboard comprising:

a substantially rigid and substantially waterproof casing, said casing defining a casing external wall, said casing external wall having a casing wall inner surface, said casing defining a casing inner volume and a filling aperture extending into said casing, said casing being positionable in a predetermined relationship relative to the building wall; and a filler, said filler being provided within said casing inner volume, said filler substantially contacting said casing inner surface for minimizing an amount of air between said filler and said casing external wall;

wherein:

said casing includes a casing base positionable substantially adjacent said ground surface, a casing upper portion and a casing intermediate portion extending between said casing base and said casing upper portion;

said casing inner volume includes an inner volume first section extending from said casing base up to a baseboard first filling level and a casing inner volume second section extending from said baseboard first filling level up to a baseboard second filling level;

said filler includes a first filling material filling said inner volume first section and a second filling material different from said first filling material filling said inner volume second section; and said casing and said first and second filling materials are positionable so that said first and second filling materials are in substantially lateral contact with the building wall.

2. A protective baseboard as defined in claim 1, wherein said second filling material is an injectable material and wherein said casing defines an injection aperture allowing the injection of said injectable material within said casing.

3. A protective baseboard as defined in claim 1, further comprising:

an upper sealing strip extending between said casing upper portion and the building wall; and a base sealing strip extending between said casing base and the ground surface.

4. A protective baseboard as defined in claim 1, wherein said casing includes a first casing module and a second casing module, said first casing module defining a first casing module first end and a longitudinally opposed first casing module second end, said second casing module defining a second casing module first end and a longitudinally opposed second casing module second end, said first casing module second end being welded to said second casing module first end with at least one solder tack.

5. A protective baseboard for protecting a building wall in an industry requiring sanitary precautions, said protective baseboard being positionable substantially adjacent a ground surface, said protective baseboard comprising:

a substantially rigid and substantially waterproof casing, said casing defining a casing external wall, said casing external wall having a casing wall inner surface, said casing defining a casing inner volume and a filling aperture extending into said casing, said casing being positionable in a predetermined relationship relative to the building wall; and a filler, said filler being provided within said casing inner volume, said filler substantially contacting said casing inner surface for minimizing an amount of air between said filler and said casing external wall;

wherein:

said casing includes a casing base positionable substantially adjacent said ground surface, a casing upper portion and a casing intermediate portion extending between said casing base and said casing upper portion;

said casing inner volume includes an inner volume first section extending from said casing base up to a baseboard first filling level and a casing inner volume second section extending from said baseboard first filling level up to a baseboard second filling level;

said filler includes a first filling material filling said inner volume first section and a second filling material different from said first filling material filling said inner volume second section; and said first filling material defines a resting surface allowing the building wall to sit thereon and said second filling material is positioned so as to be in substantially lateral contact with the building wall.

6. A protective baseboard as defined in claim 5, wherein said first filling material includes concrete.

7. A protective baseboard as defined in claim 5, wherein said second filling material is an injectable material and wherein said casing defines an injection aperture allowing the injection of said injectable material within said casing.

8. A protective baseboard as defined in claim 5, wherein said second filling material includes an expandable and injectable foam.

9. A protective baseboard as defined in claim 5, wherein said casing includes an anchoring component extending substantially inwardly within said inner volume first section, said anchoring component being embedded within said first filling material.

10. A protective baseboard as defined in claim 5, wherein said casing upper section is angled with respect to an horizontal direction at an upper section-to-horizontal direction angle, said upper section-to-horizontal direction angle being at least about 45 degrees.

11. A protective baseboard as defined in claim 5, wherein said casing is washable with a cleaning liquid and said casing base defines a substantially outwardly extending lip for directing the cleaning liquid away from said protective baseboard when said protective baseboard is washed with the cleaning liquid.

12. A protective baseboard as defined in claim 5, further comprising:

an upper sealing strip extending between said casing upper portion and the building wall; and a base sealing strip extending between said casing base and the ground surface.

13. A combination of a building wall and a protective baseboard for use in an industry requiring sanitary precautions, said protective baseboard being positionable substantially adjacent a ground surface, said combination comprising:

said building wall; and said protective baseboard, said protective baseboard including a substantially rigid and substantially waterproof casing, said casing defining a casing external wall, said casing external wall defining a casing wall inner surface, said casing defining a casing inner volume and a filing aperture extending therethrough, said casing being positionable in a predetermined relationship relative said building wall; and a filler, said filler being provided within said casing inner volume, said filler substantially contacting said casing inner surface for minimizing an amount of air between said filler and said casing external wall, wherein:

said casing includes a casing base positionable substantially adjacent said ground surface, a casing upper portion and a casing intermediate portion extending between said casing base and said casing upper portion;

said casing inner volume includes an inner volume first section extending from said casing base up to a baseboard first filling level and a casing inner volume second section extending from said baseboard first filling level up to a baseboard second filling level;

said filler includes a first filling material filling said inner volume first section arid a second filling material different from said first filling material filling said inner volume second section; and said first filling material defines a resting surface allowing the building wall to sit thereon and said second filling material is positioned so as to be in substantially lateral contact with the building wall.

* * * * *